US005406298A

United States Patent [19]

Walters

[11] Patent Number: 5,406,298

[45] Date of Patent: Apr. 11, 1995

[54] SMALL WIDEBAND PASSIVE/ACTIVE ANTENNA

[75] Inventor: Glenn A. Walters, Escondido, Calif.

[73] Assignee: The United States of America as represented by the Secretary of the Navy, Washington, D.C.

[21] Appl. No.: 718,772

[22] Filed: Apr. 1, 1985

[51] Int. Cl.[6] ..... H01Q 13/02

[52] U.S. Cl. ..... 343/776; 343/786

[58] Field of Search ..... 343/786, 776, 16 M, 343/777, 778, 779, 782, 783

[56] References Cited

U.S. PATENT DOCUMENTS

| | | | |
|---|---|---|---|
| 2,691,731 | 10/1954 | Miller | 343/786 |
| 2,933,731 | 4/1960 | Foster et al. | 343/786 |
| 3,005,983 | 10/1961 | Chandler | 343/753 |
| 3,045,238 | 7/1962 | Cheston | 343/776 |
| 3,101,472 | 8/1963 | Goubau | 343/361 |
| 3,146,454 | 8/1964 | Caron | 343/848 |
| 3,389,394 | 6/1968 | Lewis | 343/725 |
| 3,458,862 | 7/1969 | Franks | 343/786 |
| 3,787,872 | 1/1974 | Kauffman | 343/911 |
| 3,938,159 | 2/1976 | Ajoika et al. | 343/786 |
| 3,942,447 | 3/1976 | Van Orsdel et al. | 102/70.2 P |
| 4,096,482 | 6/1978 | Walters | 343/776 |
| 4,127,857 | 11/1978 | Capps et al. | 343/754 |
| 4,358,770 | 11/1982 | Satoh et al. | 343/786 |

FOREIGN PATENT DOCUMENTS

| | | | |
|---|---|---|---|
| 2490025 | 3/1982 | France | 343/786 |

*Primary Examiner*—Gilberto Barro , Jr.

*Attorney, Agent, or Firm*—Harvey Fendelman; Thomas Glenn Keough

[57] ABSTRACT

An array of five, ridge waveguide horns provides monopulse operation over a two octave range. A unique coax-to-ridge waveguide input coupler and an extended ridge matching section at the radiating apertures provide the extended frequency range. The horn assembly is lightweight, compact and suitable for array applications. A five horn monopulse primary feed array is exemplified.

9 Claims, 4 Drawing Sheets

SMALL WIDEBAND PASSIVE/ACTIVE ANTENNA

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

There is an increasing demand for efficient antenna systems capable of operating over large bandwidths in both transmit and receive modes whose dimensional requirements are such that they can be used either as a single horn, a multi-horn primary feed or that can be arrayed to provide high gain secondary patterns. Design conflicts involved are well recognized by antenna engineers. Wideband frequency operations suggest the use of angular or periodic elements such as spirals or arrays of periodic elements. Such devices, however, are inefficient and difficult to instrument at frequencies above 10 GHz.

Single and double ridge waveguides are capable of operating over 3:1 bandwidths. The power capacity and transmission efficiency of ridge waveguides is not as great as for standard rectangular guides but is far better than that associated with coaxial or spiral circuits. The horns of the present invention utilize both single and double ridged waveguide. The system described in this disclosure extends the techniques and means described in the inventor's previously issued patent, U.S. Pat. No. 4,096,482. New mechanisms disclosed herein provide an optimum match within the coaxial-to-ridge waveguide input transformation and utilize a waveguide beyond cut-off guide termination. The radiating apertures of the horns of the present invention are matched to free space by extending the ridges beyond the confines of the waveguide while increasing the gap dimensions in an exponential manner.

SUMMARY OF THE INVENTION

Generally, an optimum spacing between adjacent horns of a monopulse primary feed is close to $0.5\lambda$, where $\lambda=2\pi f$ and where f is the midband of the device operating frequency. When operating over a two octave range (4:1 frequency range), the wavelength changes by a factor of 4:1. With approximately $\frac{3}{4}$ wavelengths between adjacent horns, grating lobes are introduced that deteriorate pattern characteristics. For two octave operation, the spacing between adjacent horns varies over the frequency band of interest from 3/16 to $\frac{3}{4}$ wavelength. The apparent phase center of the horn is established by the position of the ridge gap center. To control the apparent center position, in accordance with the present invention, a single ridge guide is transformed to a dual ridge waveguide within the flared sections of the waveguide beginning at the step of the single ridge closest to the radiating aperture and extending to the radiating aperture.

In accordance with the present invention, in order to optimize the monopulse array pattern characteristics, a five horn feed is described. The central horn is used for the sum pattern in both the transmit and receive modes. Four outer horns, in combination with their hybrid circuitry, form the quadrature difference patterns. To avoid problems associated with wideband microwave hybrids, the difference patterns are optimized over the large frequency range of operation by first converting the radio frequency (RF) signals to intermedite frequency (IF) signals and then at the common frequency of operation, the signals so converted are combined through appropriate hybrid circuits to form the monopulse difference patterns.

OBJECTS OF THE INVENTION

Accordingly, it is the primary object of the present invention to provide a new and useful horn antenna that operates in an efficient manner over a large frequency bandwidth. The horn antenna described can be used as a single horn feed or as an element within an array.

A second objective of the present invention is to disclose a novel array of five of the antenna horns described above into a monopulse primary feed configuration that achieves an operating frequency range greater than two octaves.

Another object of the present invention is to disclose a novel coupling mechanism for coupling a coaxial line to a ridge waveguide transmission line that is capable of operating over a large frequency bandwidth.

A still further object of the present invention is to disclose a mechanism for matching the impedance of a ridge waveguide to the impedance of free space over a large operating bandwidth in a compact and efficient manner.

It is a concommitant object of the present invention to disclose a novel antenna horn that achieves a VSWR of better than 2:1 over a two octave bandwidth.

Another object of the present invention is to disclose a novel antenna horn that enables greater missile range (approximately 4 times the range of spiral antennas) and that simultaneously has lower transmitter power requirements.

Other objects, advantages and novel features of the invention will become apparent from the following detailed description of the invention when considered in conjunction with the accompanying drawings.

DESCRIPTION OF THE PREFERRED EMBODIMENT

Figure 1A:
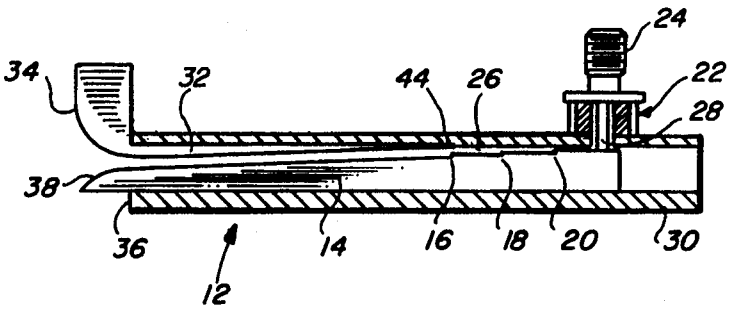
FIG. 1A is a cross-sectional view taken along lines A—A of FIG. 1 illustrating the coaxial to free space matching transformer of the present invention and also illustrating the matching mechanism of the present invention that utilizes both a section of single ridge waveguide and a section of dual ridge waveguide in order to place the phase center on the geometric center of the horn and to match the impedance of the coaxial line to the impedance of free space.
Figure 1:
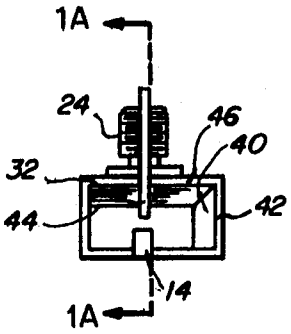
FIG. 1 is an end view of an antenna horn in accordance with the present invention viewed from the radiating end.

Referring now to FIGS. 1 and 1A a single radiating horn antenna element in accordance with the present invention is illustrated and will be described. FIGS. 1 and 1A illustrate the basic horn antenna element of the present invention. The horn antenna element described includes a waveguide 12 including a single stepped ridge 14 including ridge transformation sections 16, 18 and 20. Coaxial transformation section 22 is affixed to the waveguide 12 in order to accommodate the connection of coaxial connector 24 which enters its signal input into the waveguide cavity 26 via coaxial probe 28. A section of waveguide beyond cutoff 30 extends from waveguide 12 rearwardly from the coaxial probe 28. The waveguide beyond cutoff 30 is used as a termination because the ridge 14 has been discontinued at the point of entry of the coaxial probe 28 into the waveguide 12. Through experimentation it has been discovered that using a waveguide beyond cutoff as illustrated in FIG. 1A provides an improved mechanism for obtaining a wideband impedance match. The dimensions of the ridge 14 and the steps 16, 18 and 20 are selected in order to achieve the bandwidth requirements of the system. For example, where a two octave bandwidth is required, the highest acceptable impedance for the waveguide circuit 12 is approximately 100 ohms. Higher impedances are achieved by lowering the height of the ridge 14. The adverse effect in lowering the height of the ridge 14 is to raise the cutoff frequency of the desired TE01 mode and to lower the frequency of an undesired higher order TE03 mode, i.e. the effect is to narrow the operational bandwidth.

Figure 2:
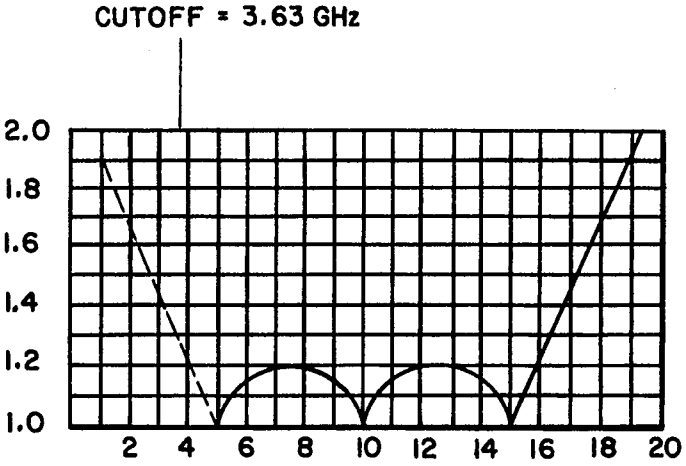
FIG. 2 is a typical plot of the VSWR as a function of frequency of the section illustrated in FIG. 1A.
Figure 1B:
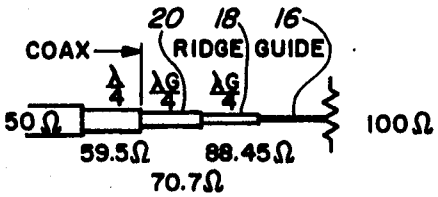
FIG. 1B is an impedance diagram of the stepped transformer impedance matching section of FIG. 1A.

The impedance of the input coaxial line 24 is, by convention, 50 ohms. The required 2:1 impedance transformation over the desired frequency bandwidth is accomplished in accordance with the teachings of Seymore B. Cohn. See, for instance, Cohn, Seymore B., "*Optimum Design Of Stepped Transmission Line*", *MTT-3, No.* 3, April 1955, pp. 6–21. and Cohn, Seymore B., "*Properties of Ridge Waveguide*", *Proc. IRE*, August, 1947, pp. 783–786. The quarterwave impedance transformation steps 16, 18 and 20 are shown schematically in FIG. 1B. The resulting VSWR as a function of frequency is illustrated in FIG. 2.

In accordance with the present invention, the single ridge waveguide including waveguide 12 and stepped ridge 14 is converted at step 16 to a dual-ridge flared waveguide. Accordingly, a second ridge 32 is utilized within the waveguide 12. The ridge 32 extends from a point within the guide opposite step 16 and extends in an exponential curve 34 from the end of the guide 36 to free space. Similarly, the ridge 14 extends beyond the edge of the guide 36 in an exponential curve 38 into free space. As can be seen in FIGS. 1 and 1A the extension 34 of ridge 32 protrudes beyond the edge of guide 36 beyond both the longitudinal axis and the transverse axis of waveguide 12. It can also be appreciated from FIG. 1 that the ridges 14 and 32 are asymetrically located with respect to the narrow walls of the waveguide 12 and that the longitudinal axes of these ridges 14 and 32 is nearer the left sidewall than the right sidewall of waveguide 12 as depicted in FIG. 1. The effect of the exponentially curved extensions 34 and 38 of the ridges 32 and 14, respectively, is to match the impedance within the guide to that of free space and thereby provides an efficient impedance match to free space. This impedance match to free space is further facilitated by flaring the waveguide 12. Specifically, at point 16 within the waveguide 12, the waveguide sidewall 40 is flared outwardly towards the radiating end to sidewall edge 42 at the radiating end 36 of the waveguide 12. Similarly, upper broadwall 44 is flared upwards to edge 46 at the radiating end 36 of waveguide 12.

Figures 3A, 3B:
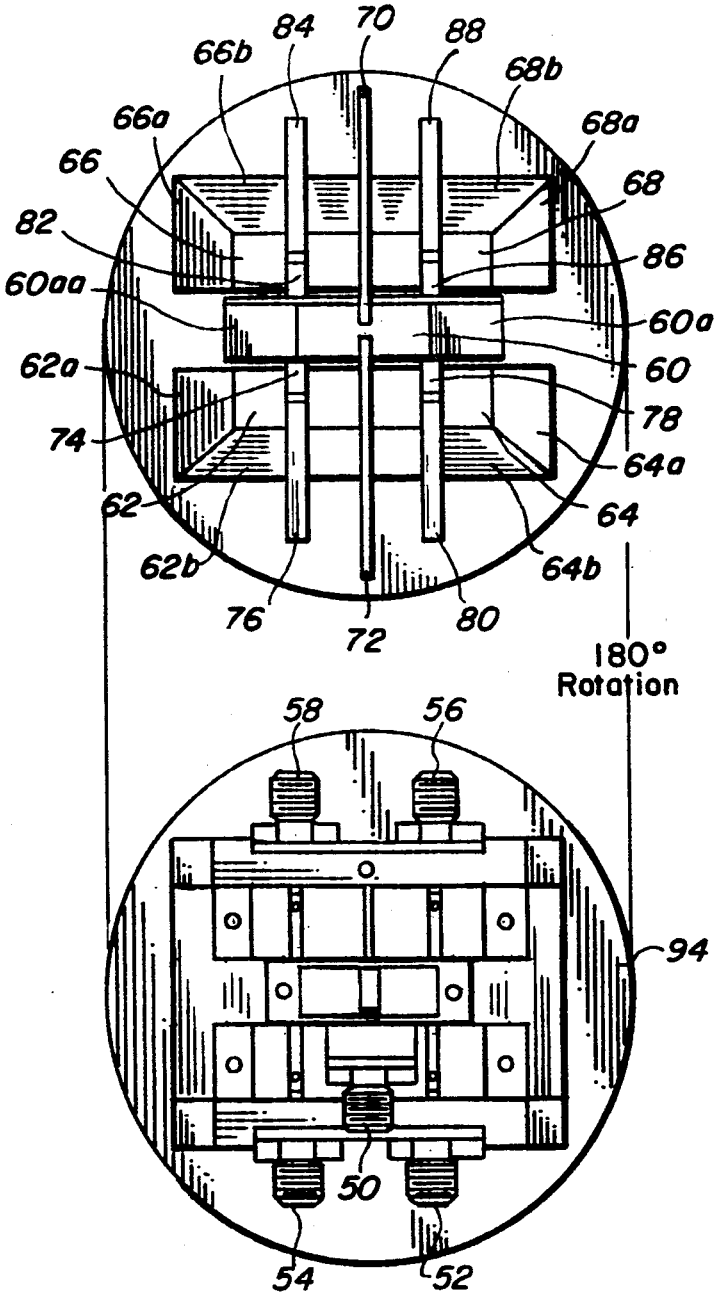
FIGS. 3A, 3B, 3C and 3D are, respectively, a front aperture view, a rear view, a side view and a top view of a five horn feed and lens arrangement in accordance with the present invention.
Figure 3C:
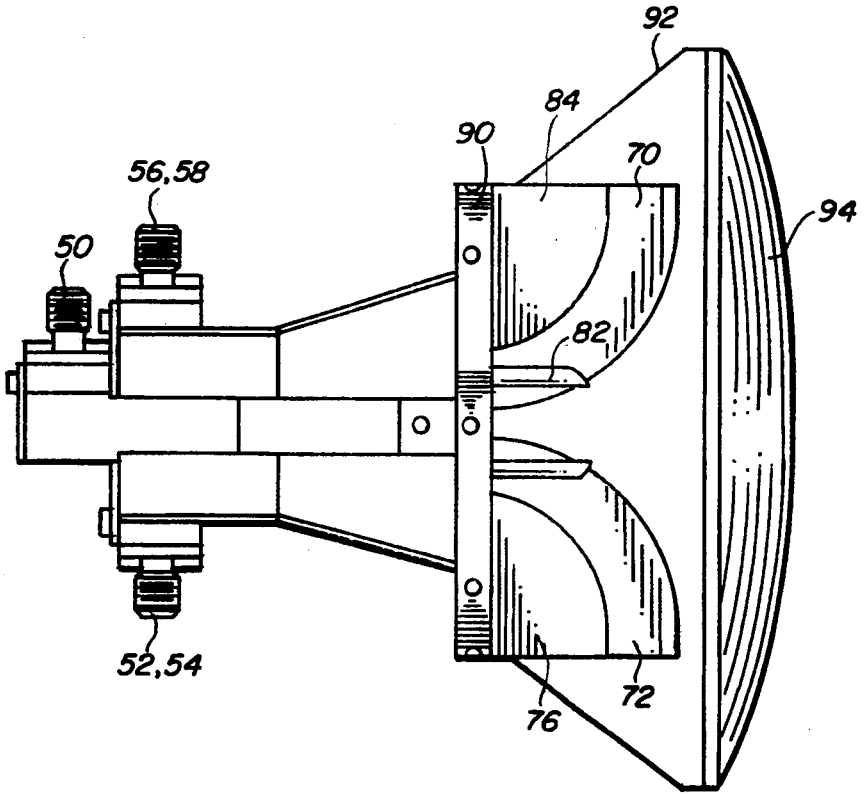
Figure 3D:
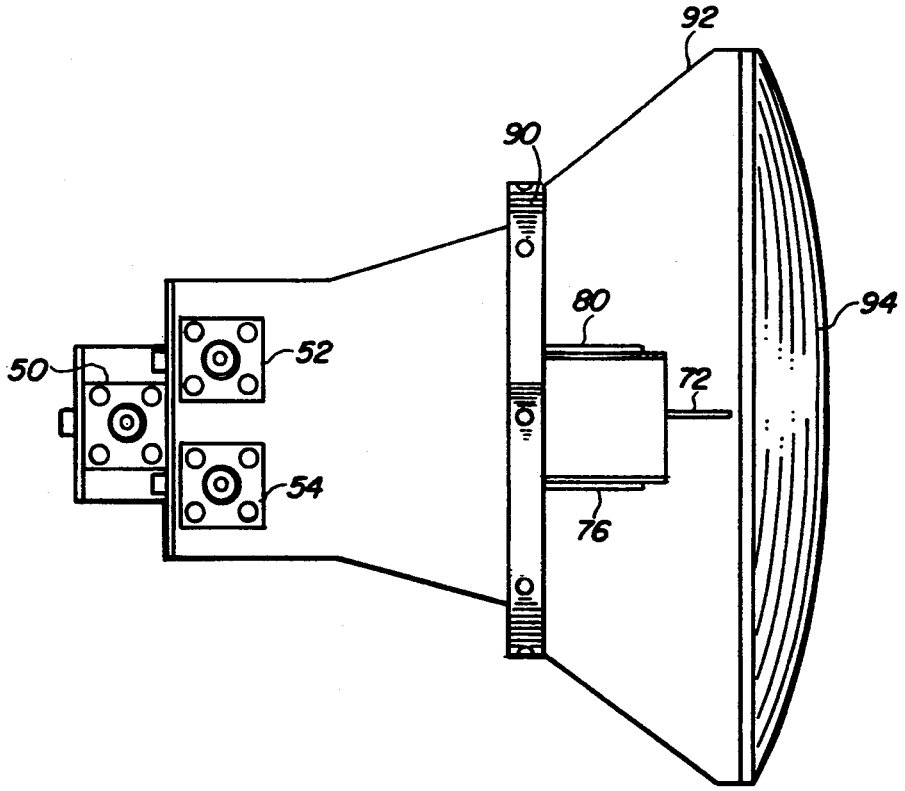

In accordance with the present invention a five horn primary feed structure illuminating a lens is illustrated in FIGS. 3A, 3B, 3C and 3D to be described. The transmission line configuration of each of the five horns in FIGS. 3A, 3B, 3C and 3D is identical to that described and illustrated in FIG. 1A with the exception that the center horn is symmetrically flared out at both sidewalls as opposed to only one sidewall flare for the four other horns and with the further exception that the center horn is not flared out at the top broadwall as are the four other radiating horns. Coaxial inputs 50, 52, 54, 56 and 58 are the inputs, via the ridge waveguide transmission line of the present invention to the five radiating apertures 60, 62, 64, 66 and 68, respectively. Coaxial input 50 couples through its transmission line to radiating aperture 60 which is the central radiating horn of the five horn assembly illustrated in FIGS. 3A, 3B, 3C and 3D. Similarly, the lower two coaxial inputs 52 and 54 coupled to the lower two difference horns which are the radiating apertures 62 and 64, respectively. Likewise, the upper two coaxial inputs 56 and 58 couple to the upper difference channel radiating horns 66 and 68. As can be seen clearly in FIG. 3A, the radiating antenna horns 62, 64 66 and 68 include flared sidewalls **62*a*, 64*a*, 66*a* and 68*a*, respectively which correspond to the flared sidewalls defined by the edges 40–42 of FIG. 1. It can also be appreciated that FIG. 3A illustrates the flared upper broadwalls, namely flared broadwalls 62*b*, 64*b*, 66*b* and 68*b* which correspond to the flared upper broadwall defined by the edges 44–46 of FIG. 1. Center radiating aperture 60 includes two flared sidewalls, namely 60*a* and 60*aa*. As stated above it is again noted that central radiating horn 60** does not include a flared broadwall portion as do each of the four radiating horns at the periphery of the five horn device disclosed.

In the design of the radiating horns of the present invention, as briefly described above with regard to FIGS. 1 and 1A, the waveguide ridges of each horn are extended outward from the radiating aperture of the horn into free space in a pseudo-exponential manner. In this way, they form vanes having an equivalency of a parallel wire transmission line circuit. Utilizing this technique, single ridge waveguide is transformed into dual ridge waveguide. Through this single-to-dual ridge waveguide transition, the central radiating aperture has its output gap at the center of the antenna array assembly. With regard to central radiating horn 60, the two ridges 70 and 72 extend outward from the radiating aperture 60 into space to form vanes 70 and 72. This provides a ridge waveguide to free space impedance transformation over a very wide frequency range. Similarly, the ridges within the upper and lower difference channel horns 62, 64, 66 and 68 are transformed to dual ridge waveguide configurations as illustrated with regard to FIGS. 1 and 1A such that the ridge gaps are centered at equal distances from the array center. These ridges then extend outwardly into free space in the form of exponentially contoured vanes. Thus, vanes 74 and 76 extend from radiating horn 62; vanes 78 and 80 extend from horn 64; vanes 82 and 84 extend from horn 66; and vanes 86 and 88 extend from radiating horn 68.

The ridge extension pairs 74 and 76, 78 and 80, 82 and 84, and 86 and 88 correspond to the ridge extensions 38 and 34 illustrated in FIG. 1A. The asymmetrical position with respect to the narrow walls of their respective waveguides of the pairs of transformation sections 74 and 76, 78 and 80, 82 and 84, and 86 and 88 has the effect of moving the phase centers in towards the center of the five-horn radiating structure so that at the highest frequency of operation the phase centers are at a maximum wavelength in both planes so as to minimize grating lobes in the radiation pattern.

The afterside of all of the vanes 70 through 88, inclusive, is terminated on ground plate 90. The ground plate 90 acts as the mounting ring for a lens support structure 92 and collimating lens 94. The purpose of lens 94 is to focus the energy from the primary monopulse feed into a narrower secondary pattern. An alternate approach utilizing lens 94 is to use the primary feed to illuminate a secondary reflector such as a parabolic reflector.

Figure 4:
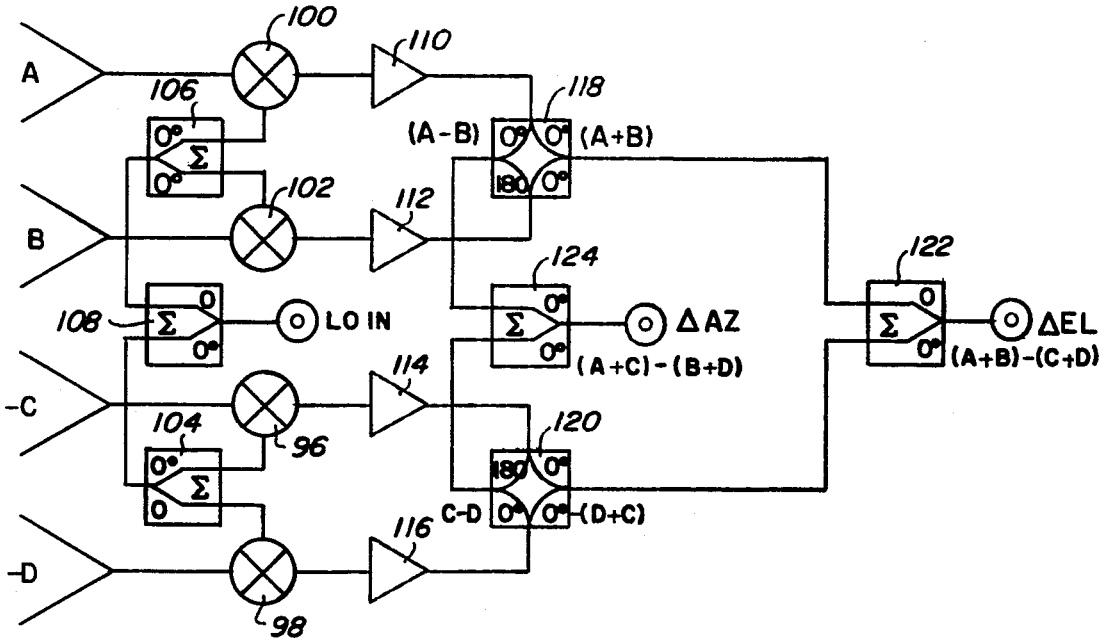
FIG. 4 is a block diagram, by way of example, of hybrid circuits utilized to form monopulse antenna patterns in association with the five horn antenna of the present invention.
Figure 4A:
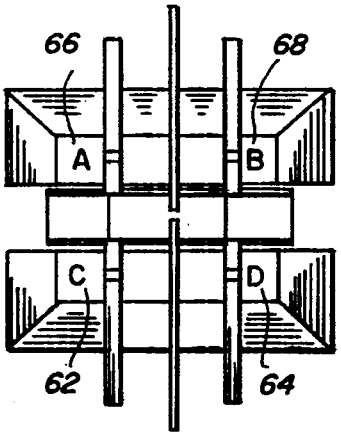
FIG. 4A is a front view of the five horn antenna of the present invention reproduced for convenience in referring to FIG. 4.

By way of example, a monopulse circuit diagram suitable for use with the present invention is illustrated in FIG. 4. Energy from radiating antenna horns 62, 64, 66 and 68 are directed to mixers 96, 98, 100 and 102, respectively. These signals are mixed with a local oscillator signal via a corporate power divider that is comprised of power dividers 104, 106, and 108. The intermediate frequency (IF) signals from mixers 100, 102, 96 and 98 are amplified through IF amplifiers 110, 112, 114 and 116. The IF signals from the amplifiers 110 and 112 are inputted to 180° hybrid 118. Similarly, the IF outputs from amplifiers 114 and 116 are directed to 180° hybrid 120. It should be noted that signals C and D derived from horns 62 and 64, respectively as is illustrated in FIG. 4A, are in space opposition, 180° out of phase from the signals A and B derived from horns 66 and 68, respectively. Thus, the sum and difference outputs from hybrids 118 and 120 are essentially out of phase. The sum outputs (A+B) and −(C+D) are summed in hybrid 122 to provide the elevation difference channel output. Similarly, the difference outputs from hybrids 118 and 120 are combined in hybrid 124 to provide the azimuth difference output. The conversion to IF frequencies, while requiring one additional amplifier, eliminates the problems associated with the operation of wideband microwave hybrids.

While the described horn was designed for operation over a two octave bandwidth, it has been discovered that with the exception of a large impedance mismatch over narrow bandwidths around the first two higher order modes, an acceptable impedance extended into an upper band were in the quarterwave sections of the coax and ridge waveguide transformer sections became three quarter wavelength sections; i.e., a four octave coverage. While arrays of such horns would not produce acceptable patterns over such a large frequency range, a single horn feed of the type disclosed herein could be used to eliminate a parabolic reflector for effective operation over many octaves.

Obviously many modifications and variations of the present invention are possible in the light of the above teachings. It is therefore to be understood that within the scope of the appended claims the invention may be practiced otherwise than as specifically described.

What is claimed is:

1. A horn antenna element including a coaxial to free space transition comprising:

a waveguide having a feed end, a radiating end and a longitudinal axis;

a coaxial connector assembly attached to said waveguide adjacent said feed end;

first ridge transformation section means mounted within said waveguide in the vicinity of said feed end for coacting with said waveguide so as to form a section of single ridge waveguide;

second ridge transformation section means mounted within said waveguide in the vicinity of said radiating end and opposite to said first ridge transformation section means for coacting with said waveguide and with said first ridge transformation section means so as to form a section of dual ridge waveguide;

said first and second ridge transformation section means each extending beyond said radiating end into free space so as to create an impedance therebetween approximating the impedance of free space, said second ridge transformation section extending beyond said radiating end in both longitudinal and transverse directions with respect to said longitudinal axis of said waveguide.

2. The antenna element of claim 1 wherein:

said first and second ridge transformation section means each extend beyond said radiating end in the form of opposing exponentially curved vanes; and said waveguide has first and second narrow walls and said first and second ridge transformation section means are asymmetrically positioned nearer to said first narrow wall than to said second narrow wall.

3. The antenna element of claim 1 wherein:

said first ridge transformation section means includes first, second and third stepped ridges.

4. An antenna array comprised of first, second, third, fourth and fifth horn antenna elements as described in claim 1 wherein:

said first, second, third and fourth horn antenna elements are disposed at the periphery of a rectangle and said fifth horn antenna element is disposed at the center of said rectangle.

5. The antenna array of claim 4 wherein:

the waveguide of each of said first, second, third, fourth and fifth antenna elements is terminated in a section of waveguide beyond cutoff located at said feed end and extending beyond the point of connection of said coaxial connector assembly to said waveguide.

6. The horn antenna element of claim 1 wherein:

said waveguide is terminated in a section of waveguide beyond cutoff located at said feed end and extending beyond the point of connection of said coaxial connector assembly to said waveguide.

7. The horn antenna element of claim 1 wherein said waveguide is flared outwardly at said radiating end.

8. The antenna array of claim 4 wherein:

the waveguide of each of said first, second, third, fourth and fifth antenna elements is flared outwardly at said radiating end.

9. The antenna array of claim 4 wherein:

each pair of said first ridge transformation section means and said second ridge transformation section means in each of said first, second, third, and fourth horn antenna elements forms a ridge gap and wherein each of said ridge gaps are positioned at equal distances from the center of said fifth horn antenna element.

* * * * *